US005623729A

United States Patent [19]

Chen

[11] Patent Number: 5,623,729

[45] Date of Patent: Apr. 29, 1997

[54] CHEST PROTECTOR

[76] Inventor: Mike C. Chen, 17, Kung 6 Road, Linkou 2nd Industrial Park, Taipei Hsien, Taiwan

[21] Appl. No.: 593,910

[22] Filed: Jan. 30, 1996

[51] Int. Cl.[6] ..... A41D 13/00

[52] U.S. Cl. ..... 2/461; 2/2.5; 2/45; 2/463; 2/464

[58] Field of Search ..... 2/2, 2.5, 44, 45; 273/26 C; D29/115

[56] References Cited

U.S. PATENT DOCUMENTS

| | | | |
|---|---|---|---|
| 295,543 | 3/1884 | Gray | 2/2 |
| 1,670,239 | 5/1928 | Cline | 2/2 |
| 2,468,841 | 5/1949 | Siegel . | |
| 2,796,208 | 6/1957 | O'Leary et al. . | |
| 2,990,549 | 4/1961 | Doughty . | |
| 3,076,197 | 2/1963 | Glahe . | |
| 3,125,762 | 3/1964 | Glahe . | |
| 3,574,861 | 4/1971 | Hale . | |
| 3,803,639 | 4/1974 | Cohen . | |
| 4,525,875 | 7/1985 | Tomczak . | |
| 4,847,913 | 7/1989 | Chen . | |
| 4,993,076 | 2/1991 | Dierickx | 2/2 |
| 5,020,156 | 6/1991 | Neuhalfen | 2/2.5 |

FOREIGN PATENT DOCUMENTS

| | | | |
|---|---|---|---|
| 490913 | 5/1919 | France | 2/2.5 |

*Primary Examiner*—Bibhu Mohanty
*Attorney, Agent, or Firm*—Diller, Ramik & Wight, PC

[57] ABSTRACT

The chest protector of the present invention consists of an upper guard portion and a lower padding portion, the upper guard portion comprising a right and a left shoulder guard panels, a chest guard panel and a plurality of abdomen guard panels, each being injection molded from engineering plastic and provided with a plurality of holes, so that respective guard panels are connected with one another by means of a plurality of connecting plates and the buttons provided on the connecting plates.

When the upper guard portion is assembled into a proper shape and size, the lower padding portion with corresponding shape and size can be selected with the upper guard portion being laid on the lower padding portion, and then having rivets driven into those holes on the guard panels not occupied by the buttons of the connecting plates, so that the upper guard portion is secured to the lower padding portion.

5 Claims, 4 Drawing Sheets

CHEST PROTECTOR

BACKGROUND OF THE INVENTION

The present invention relates to a chest protector and, in particular, to such a chest protector for use by baseball or softball catchers or umpires.

Conventional chest protectors, such as that disclosed in U.S. Pat. No. 4,847,913 issued to the same applicant of the present invention, is formed integrally of polyurethane (PU) foam. Although easy to be manufactured, yet these chest protectors are often unable to effectively disperse and absorb the impact force as being hit by a ball with strong force, thus causing discomfort to the user. Further, even though other rigid materials, such as sticks or blocks made of an engineering plastic, can be provided into the PU foam to disperse the impact force, such kind of conventional protectors are difficult to be manufactured, and are also difficult to be folded for storage. If it is desired to make chest protectors of different sizes suitable for players of different physical builds, it is even more difficult to control the quality and to meet the requirements by the users.

SUMMARY OF THE INVENTION

The chest protector of the present invention consists of an upper guard portion and a lower padding portion, the upper guard portion comprising a right and a left shoulder guard panels, a chest guard panel and a plurality of larger and smaller abdomen guard panels, each being injection molded from rigid and impact-resistant plastic material and provided with a plurality of holes, so that respective guard panels are connected to one another by means of a plurality of connecting plates and the buttons provided on the connecting plates.

When the upper guard portion is assembled into a proper shape and size, a lower padding portion with corresponding shape and size can be selected with the upper guard portion being laid on the lower padding portion, and then having rivets driven into those holes on the guard panels not occupied by the buttons of the connecting plates, so that the upper guard portion is secured to the lower padding portion.

The lower padding portion is formed of foam, provided with a shoulder belt at each shoulder end thereof and a waist belt across two waist ends and connected with the shoulder belts, which facilitates wearing of the user. The connecting plates are normally injection molded from soft and flexible plastic material, so that the chest protector according to the present invention can be bent and folded at the regions of connecting plates.

The chest protector of the present invention is light in weight due to the fact that the guard panels of the upper guard portion are formed of rigid and impact-resistant plastic material and the lower padding portion is made of PU foam. When being hit by a fast flying ball, the impact force is firmly offset and dispersed by the guard panels, then transmitted to the lower padding portion, and finally absorbed. The shape and size of the upper guard portion can be varied by using larger and smaller abdomen guard panels different in number and size, such that chest protectors of different shapes and sizes can be assembled by the users and even the whole chest and abdomen portion can be wrapped up thereby.

Accordingly, an object of the present invention is to provide a chest protector which is light in weight and which can effectively offset, disperse and absorb the impact force of the ball hitting with strong force.

Another object of the present invention is to provide a chest protector which can be assembled into different shapes and sizes.

A further object of the present invention is to provide a chest protector which can be easily folded for storage.

BRIEF DESCRIPTION OF THE DRAWINGS

The above and other objects, features, and advantages of the present invention will become apparent from the following detailed description of a preferred embodiment thereof in conjunction of the accompanying drawings, in which.

DETAILED DESCRIPTION OF THE INVENTION

Figure 1:
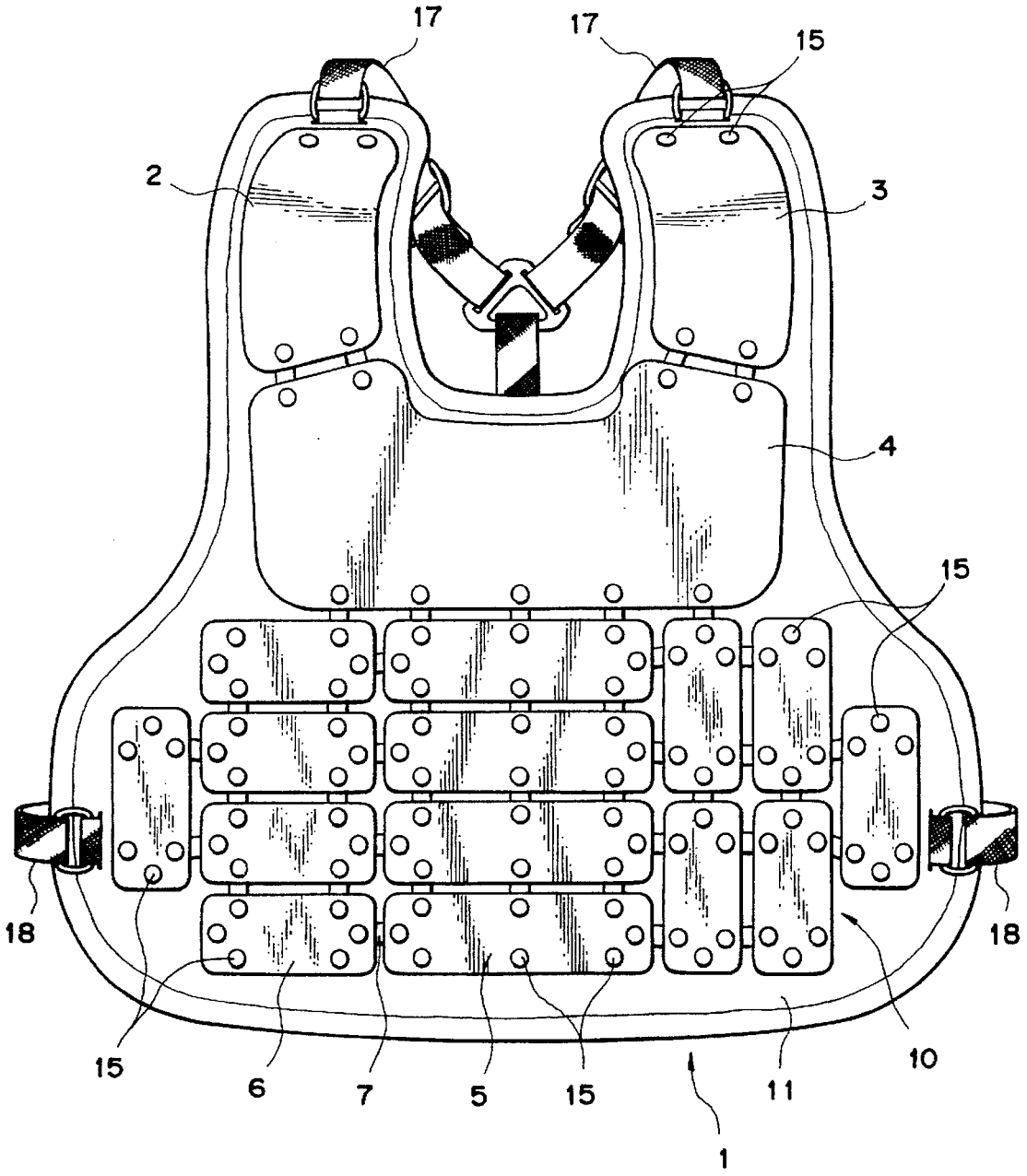
FIG. 1 is a front elevation view of the chest protector of the present invention.

Referring to the drawings, an embodiment of the present invention will be described in detail.

Figure 2:
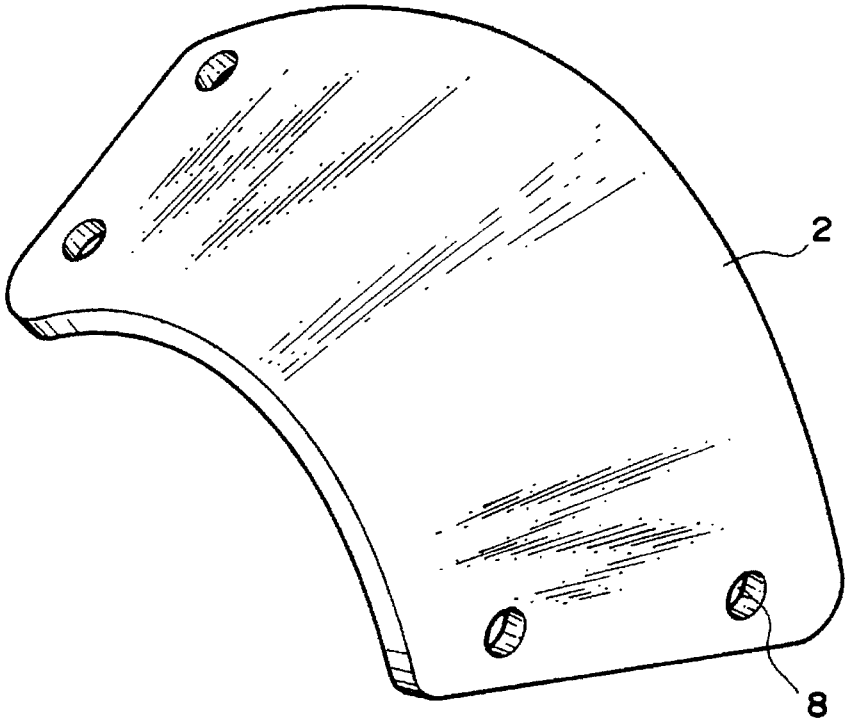
FIG. 2 is a perspective view of the right shoulder guard panel.
Figure 3:
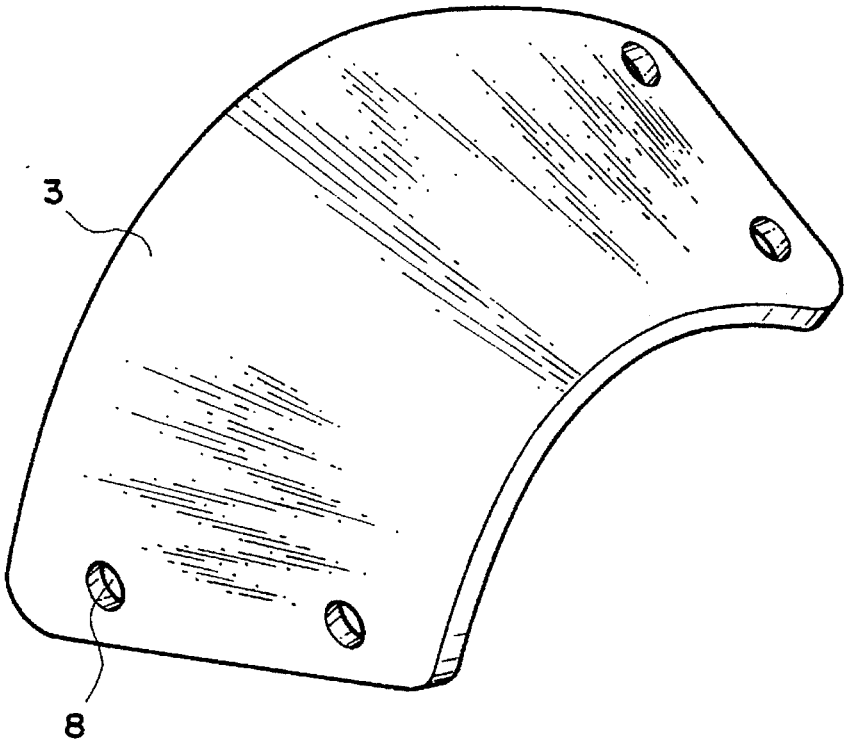
FIG. 3 is a perspective view of the left shoulder guard panel.
Figure 4:
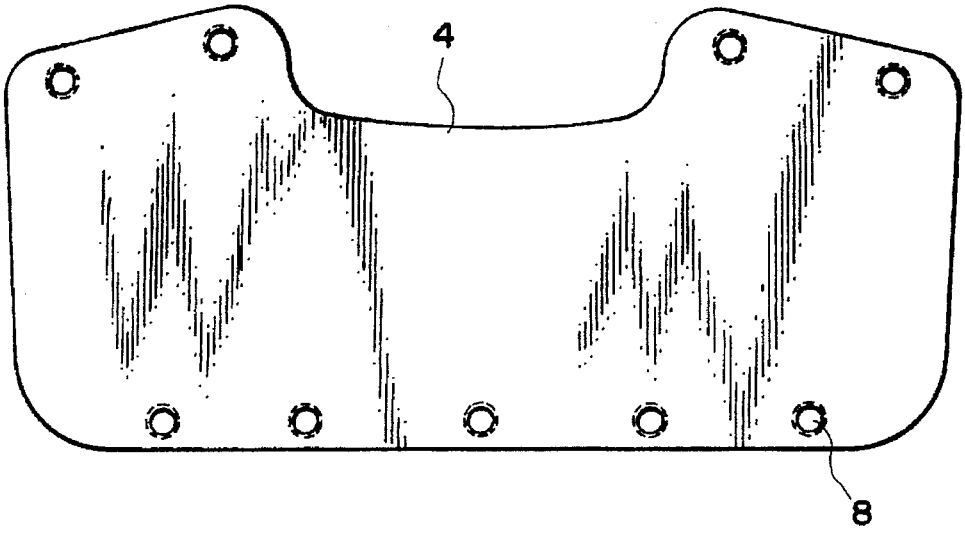
FIG. 4 is a front elevation view of the chest guard panel.

Referring to FIG. 1, the chest protector according to present invention comprises an upper guard portion 10 and a lower padding portion 11. The upper guard portion 10 consists of a right shoulder guard panel 2, a left shoulder guard panel 3, a chest guard panel 4, a plurality of larger abdomen guard panels 5, and a plurality of smaller abdomen guard panels 6 connected by means of a plurality of connecting plates 7. The right shoulder guard panel 2, the left shoulder guard panel 3, the chest guard panel 4, the larger abdomen guard panels 5, and the smaller abdomen guard panels 6 are all injection molded from rigid and impact-resistant plastic material. The connecting plates 7 can be injection molded from a soft and flexible plastic. Referring to FIGS. 2 and 3, the right shoulder guard panel 2 and the left shoulder guard panel 3 are symmetrical to each other and slightly curved to fit the curvature of the shoulder and chest of the body, and provided at the upper and lower ends thereof with a plurality of holes 8 for connection purpose.

Referring to FIGS. 1, 4, 5, and 6, the chest guard panel 4 is roughly in the shape of "U" and provided on both the upper right and left sides with a plurality of holes 8 for connecting, respectively, to the holes 8 at the lower ends of the right shoulder guard panel 2 and the left shoulder guard panel 3 by means of the connecting plates 7. The chest guard panel 4 is also provided at the lower ends thereof with a plurality of holes, so that it can be connected to the plurality of the larger abdomen guard panels 5 and the smaller abdomen guard panels 6 by means of the connecting plates 7. The chest guard panel 4 may also be curved in accordance with the curvature of the body.

Figure 5:
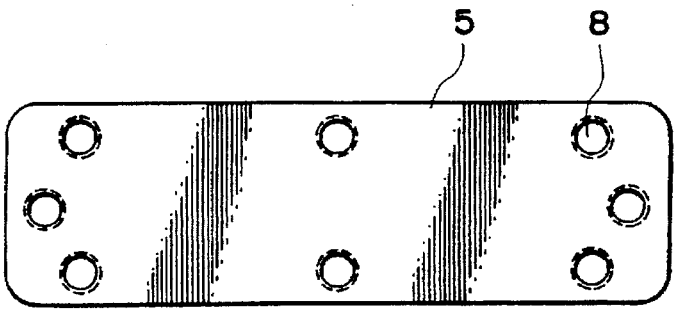
FIG. 5 is a front elevation view of the larger abdomen guard panel.
Figure 6:
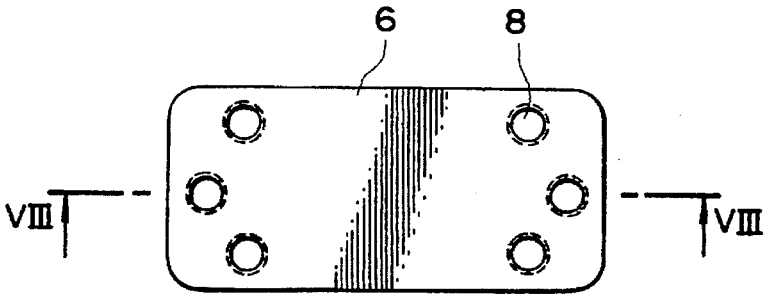
FIG. 6 is a front elevation view of the smaller abdomen guard panel.

As shown in FIGS. 5 and 6, the larger abdomen guard panels 5 and the smaller abdomen guard panels 6 may be both rectangular in shape, being provided with at least three holes 8 at both end. Referring to FIG. 1, in the case where both ends are each provided with three holes 8, when making the connections, one of the three holes 8 at the end of the larger abdomen guard panels 5 and the smaller abdomen guard panels 6 is used for connection in the major axial direction and the other two holes 8 are used for connection in the minor axial direction, with all connections being made with other larger abdomen guard panels 5 and smaller abdomen guard panels 6 by means of the connecting plates 7. The larger abdomen guard panels 5 and smaller abdomen guard panels 6 may also be curved in accordance with the curvature of the body.

As the larger abdomen guard panels 5 is slightly longer than the smaller abdomen guard panels 6, a few more holes 8 may be provided at the middle of the larger abdomen guard panels 5 for facilitating the connections in the minor axial direction.

In the embodiment shown in FIG. 1, although the larger abdomen guard panels 5 and the smaller abdomen guard panels 6 of different shapes and sizes are used to compose the upper guard portion 10, the upper guard portion 10 can also be constituted by using all smaller abdomen guard panels 6 without the larger abdomen guard panels 5. In fact, the shapes and sizes of the larger abdomen guard panels 5 and the smaller abdomen guard panels 6 can be further varied without limitation to the shapes and sizes which have been used in the assembly of the embodiment. For example, they can be rectangular of the same size (such as in the above case where only the smaller abdomen guard panels 6 are used), as well as the shape of a diamond or square of the same size. In addition, abdomen guard panels of different shapes can be alternatively used. For example, rectangular abdomen guard panels can be used interconnecting with square ones. The shapes and sizes of the upper guard portion 10 thus assembled can be varied by using a different number of the larger abdomen guard panels 5 and/or the smaller abdomen guard panels 6.

Figure 7:
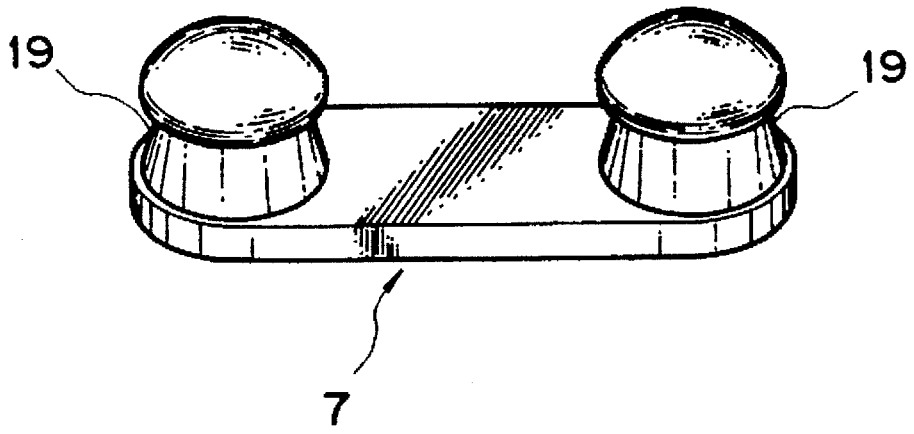
FIG. 7 is a perspective of the connecting plate.
Figure 8:
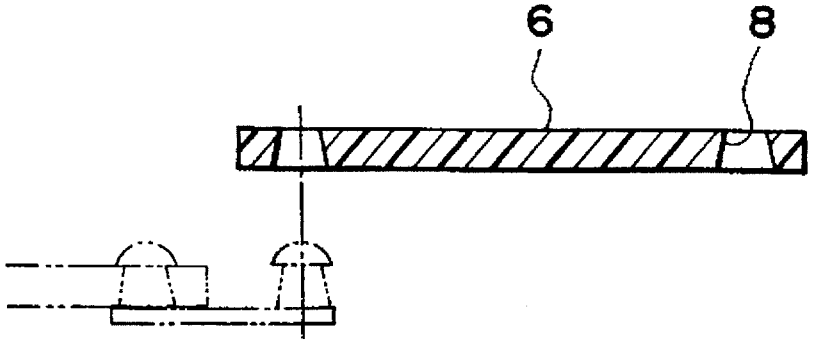
FIG. 8 is a cross section view taken along line VIII—VIII in FIG. 6.

Referring to FIG. 7, the connecting plates 7 are each provided at the ends thereof with buttons 19. Referring to FIGS. 7 and 8, the buttons 19 are in the shape of a mushroom while the holes 8 of the guard panel have a cross section in an inversely tapered shape, so that the buttons 19 can be easily snapped into the holes 8 for better fastening effect.

After the upper guard portion 10 is assembled into suitable shape and size, the lower padding portion 11 of suitable shape and size can be selected and the upper guard portion 10 is laid over the lower padding portion 11, and then rivets 15 are driven into the holes 8 on the right shoulder guard 2 and the left shoulder guard 3 and other guard panels which are not fastened by the buttons 21 of the connecting plates 7, such that the upper guard portion 10 is secured onto the lower padding portion 11. Referring the FIG. 1 again, the lower padding portion 11 is formed of PU foam, being provided at the upper right and left ends each with a shoulder belt 17 connecting with the waist belt 18 across the lower right and left ends to facilitate wearing by the user.

The above embodiment shown in FIG. 1 is described for illustrative purpose only and not in a limiting sense. Any modifications and variations (such as the shapes, the sizes, and the number of the guard panels) as well as alternative embodiments can be made by those skilled in this art according to the spirit of the present invention and the appended claims. It is intended that all such modifications, variations and embodiments are considered as being within the scope of the present invention.

What is claimed is:

1. A chest protector comprising an upper guard portion and a lower padding portion wherein said upper guard portion consists of a right shoulder guard panel, a left shoulder guard panel, a chest guard panel and a plurality of abdomen guard panels connected with one another by a plurality of connecting plates, and said lower padding portion is a soft pad provided with shoulder belts and waist belt, characterized in that:

said right and left shoulder guard panels are symmetrical to each other and slightly curved to fit the curvature of the shoulder and chest of the body, and provided at the upper and lower ends thereof with a plurality of holes for connection purpose;

said chest guard panel is disposed beneath said right and left shoulder guard panels and provided on both the upper right and left sides thereof with a plurality of holes for connecting, respectively, to the holes at the lower ends of said right and left shoulder guard panels by means of said connecting plates, the chest guard panel being provided at the lower end thereof with a plurality of holes so that it can be connected to the plurality of said abdomen guard panels by means of said connecting plates;

said abdomen guard panels are provided at both ends each with a plurality of holes so that they are connected to one another and to the chest guard panel thereabove by means of the plurality of said connecting plates;

said connecting plates are each provided at both ends thereof with buttons for fastening into said holes on said right and left shoulder guard panels, said chest guard panel, and said abdomen guard panels; and said upper guard portion is laid over said lower padding portion of suitable shape and size so that said upper guard portion is secured to said lower padding portion by means of rivets being driven into the holes, not being fastened by said buttons of said connecting plates, on the right and left shoulder guards, chest guard, and the abdomen guards.

2. The chest protector according to claim 1, wherein said abdomen guards include larger and smaller abdomen guard panels and are rectangular in shape, said larger abdomen guards are longer than the smaller abdomen guard panels in the longitudinal direction, and at least one of the plurality of said holes on the larger and smaller abdomen guard panels is used for the longitudinal connection and at least two other holes are used for the lateral connection.

3. The chest protector according to claim 1, wherein said buttons of said connecting plates are in the shape of a mushroom while said holes on said right and left shoulder guard panels, said chest guard panel and said abdomen guard panels have a cross section in an inversely tapered shape so that said buttons can be fastened into said holes.

4. The chest protector according to claim 1, wherein said right and left shoulder guard panels, said chest guard panel and said abdomen guard panels are injection molded from rigid and impact-resistant plastic material and said connecting plates are injection molded from a soft and flexible plastic material.

5. The chest protector according to claim 1, wherein said lower padding portion is formed of foam.

* * * * *